US009027502B2

(12) United States Patent
Strickland, Jr.

(10) Patent No.: US 9,027,502 B2
(45) Date of Patent: May 12, 2015

(54) ROWING SHOE RETAINING SYSTEM

(71) Applicant: Gerald Lewis Strickland, Jr., Buffalo, NY (US)

(72) Inventor: Gerald Lewis Strickland, Jr., Buffalo, NY (US)

(73) Assignee: G Clip Corporation, Buffalo, NY (US)

( * ) Notice: Subject to any disclaimer, the term of this patent is extended or adjusted under 35 U.S.C. 154(b) by 0 days.

(21) Appl. No.: 14/073,490

(22) Filed: Nov. 6, 2013

(65) Prior Publication Data

US 2014/0299037 A1 Oct. 9, 2014

Related U.S. Application Data

(60) Provisional application No. 61/722,983, filed on Nov. 6, 2012.

(51) Int. Cl.

| | |
|---|---|
| ***B63B 17/00*** | (2006.01) |
| ***A63B 5/08*** | (2006.01) |
| ***B63H 16/02*** | (2006.01) |

(52) U.S. Cl.

CPC . *B63B 17/00* (2013.01); *A63B 5/08* (2013.01); *B63H 16/02* (2013.01)

(58) Field of Classification Search

CPC ..... B63H 16/02; B63B 17/00
USPC ..... 114/343, 363
See application file for complete search history.

(56) References Cited

U.S. PATENT DOCUMENTS

| | | | | |
|---|---|---|---|---|
| 6,405,614 | B1 | 6/2002 | Beyl | |
| 6,477,917 | B1 | 11/2002 | Peyre et al. | |
| D506,308 | S | 6/2005 | Chretien et al. | |
| 7,104,159 | B2 | 9/2006 | Plassiard et al. | |
| 7,240,587 | B2 | 7/2007 | Plassiard et al. | |
| 7,421,971 | B1 * | 9/2008 | Vespoli | 114/363 |
| 7,552,695 | B1 | 6/2009 | Matsueda et al. | |
| 7,856,904 | B2 | 12/2010 | Lin | |
| D636,564 | S * | 4/2011 | Matsueda et al. | D2/902 |
| 8,015,936 | B2 | 9/2011 | Sakaue et al. | |
| 8,141,274 | B2 * | 3/2012 | Matsueda et al. | 36/50.1 |
| 8,245,597 | B2 | 8/2012 | Lin | |
| 8,458,926 | B2 * | 6/2013 | Ewans | 36/97 |
| 2006/0183385 | A1 * | 8/2006 | Kaufer | 440/21 |
| 2009/0205556 | A1 | 8/2009 | Kawahara et al. | |
| 2010/0005924 | A1 | 1/2010 | Servignat et al. | |
| 2010/0325920 | A1 * | 12/2010 | Ewans | 36/114 |
| 2011/0143607 | A1 | 6/2011 | Toth | |
| 2011/0152041 | A1 | 6/2011 | Francis | |
| 2012/0066934 | A1 | 3/2012 | West | |
| 2013/0186232 | A1 | 7/2013 | Servignat et al. | |

OTHER PUBLICATIONS

"Active Tools 2K Rowing Shoes," John Ewans Design, www.designdirectory.com/user_files/company_files/related_documents/3242_VIckCIUF4IGeKkde38H_2H6uD.pdf, Jan. 2011.

(Continued)

*Primary Examiner* — Daniel V Venne
(74) *Attorney, Agent, or Firm* — Dicke, Billig & Czaja, PLLC

(57) ABSTRACT

A rowing shoe retaining system includes a plate mountable to a sole of a shoe and a receiver mountable to a footboard of a rowing boat. The receiver removably retains the plate, thereby removably retaining the shoe.

15 Claims, 7 Drawing Sheets

(56) References Cited

OTHER PUBLICATIONS

"Foot Stretcher KF-R600," Shimano North America, http://rowing.shimano.com/content/rowing_northamerica/english/index/products/FootStretcher.html, 2013.

"Rowing Shoes SRD 600," Shimano North America, http://rowing.shimano.com/publish/content/global_rowing/nw/us, Nov. 2, 2013.

"Stretcher Plates and Footboards," Neaves Rowing Services, http://neaves-rowing.com/stretchers.html, Nov. 2, 2013.

* cited by examiner

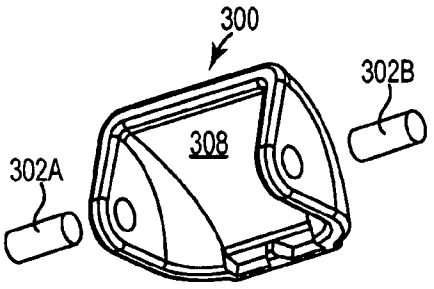
Fig. 17
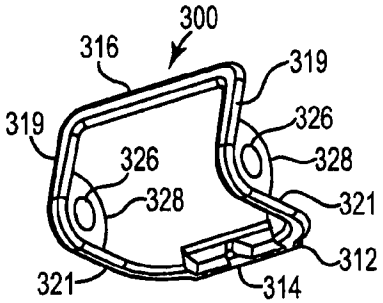
Fig. 18
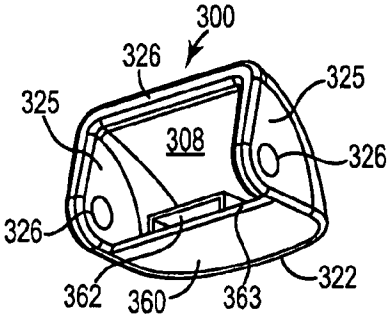
Fig. 19
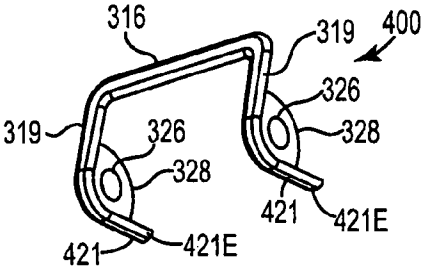
Fig. 20
Fig. 21
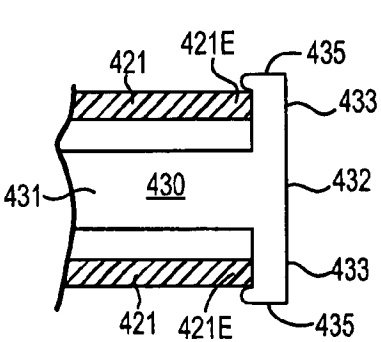
Fig. 22A
Fig. 22B
Fig. 23B
Fig. 23A
Fig. 24

ROWING SHOE RETAINING SYSTEM

CROSS-REFERENCE TO RELATED APPLICATIONS

This application is a Non-Provisional of U.S. Provisional Patent Application 61/722,983, filed Nov. 6, 2012, entitled ROWING SHOE RETAINING SYSTEM, which is incorporated herein by reference.

BACKGROUND

Traditional rowing shoes typically are permanently mounted to a footboard of rowing boat, such as a scull. Accordingly, the rowers simply have to use whatever size rowing shoe is present in the scull, leading to poor fit and unsanitary conditions, among other issues.

BRIEF DESCRIPTION OF THE DRAWINGS

FIGS. 17-21 are each a perspective view schematically illustrating a heel receiving portion of a rowing shoe fastening system, according to an example of the present disclosure.

FIG. 22A is a partial sectional top view schematically illustrating a heel receiving portion and pressure plate of a rowing shoe fastening system, according to an example of the present disclosure.

FIG. 22B is a partial sectional view schematically illustrating a portion of a pressure plate coupled to an arm of a heel receiving portion, according to an example of the present disclosure.

FIG. 23A is a partial sectional view schematically illustrating a heel receiving portion and pressure plate of a rowing shoe fastening system, according to an example of the present disclosure.

FIG. 23B is a partial sectional view schematically illustrating a portion of a pressure plate coupled to an arm of a heel receiving portion, according to an example of the present disclosure.

FIG. 24 is a perspective view schematically illustrating a heel receiving portion of a rowing shoe fastening system, according to an example of the present disclosure.

DETAILED DESCRIPTION

In the following Detailed Description, reference is made to the accompanying drawings which form a part hereof, and in which is shown by way of illustration specific examples of the present disclosure that may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense.

At least some examples of the present disclosure are directed to a quick-release rowing shoe fastening system. With this system, each rower wears their own shoes, thereby avoiding unsanitary conditions typically present in traditional rowing shoes that remain permanently mounted in the rowing scull. Wearing their own properly fitting shoes also will result in better performance and comfort, avoiding the traditional practice of a rower coping with the poor fit and discomfort of using the one-size-fits-all rowing shoes that are commonly mounted in the rowing sculls.

In some examples, the rowing shoe fastening system enables a hands-free release of the rowing shoe from a footboard without the use of a traditional pull string. In particular, instead of the traditional technique of a rower escaping via removing their foot from a permanently mounted shoe, examples of the present disclosure enable a quick-release exit via a rower removing their shoe from the footboard without removing their feet from their rowing shoes.

Besides the above-described benefits that rowing shoes offer in the rowing scull, in some examples, a rowing shoe includes both front and rear cleats sized and positioned to significantly enhance walking to and from the rowing scull. Moreover, in some examples, a rear cleat is sized to enhance proper contact and leverage against a footboard to maximize harnessing the driving, leg force exerted by the rower.

These examples, and additional examples, are described and illustrated in association with FIGS. 1-26.

Figure 1:
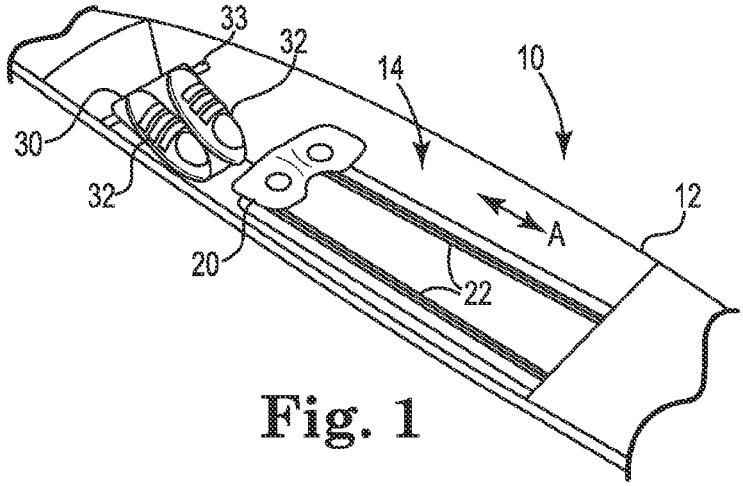
FIG. 1 is a perspective view schematically illustrating a rowing scull, according to one example of the present disclosure.

As shown in FIG. 1, a rowing scull 10 includes a shell 10 and interior 14 that houses a seat 20 and rails 22 on which the seat 20 can slide back and forth, as represented by directional arrow A. A footboard 30 is mounted relative to a sidewall and/or bottom of the shell 12 via a rod 33 or other structures. The footboard 30 provides a support surface on which a pair 29 of rowing shoes 32 is mounted.

Figure 2:
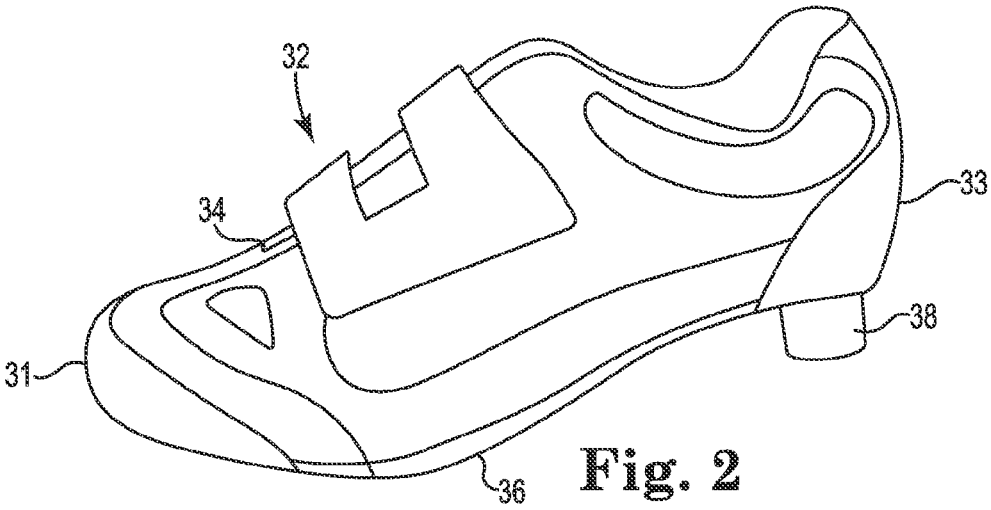
FIG. 2 is a side view schematically illustrating a rowing shoe, according to one example of the present disclosure.
Figure 3:
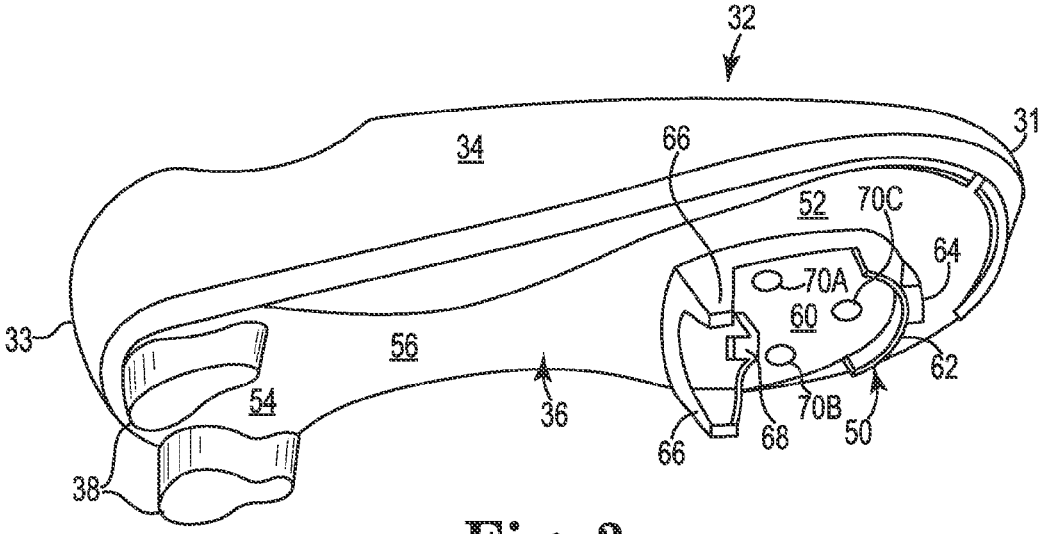
FIG. 3 is side, bottom view schematically illustrating a bottom portion of a rowing shoe, according to one example of the present disclosure.

FIG. 2 is a side view and FIG. 3 is a bottom, perspective view schematically illustrating a rowing shoe 32, according to examples of the present disclosure. As shown in FIG. 2, rowing shoe 32 includes a front end or toe portion 31, an opposite rear end or heel portion 33, an upper 34, a sole 36, and at least one rear cleat or support 38. As shown in FIG. 3, sole 36 of rowing shoe 32 includes a heel/rear portion 54, an intermediate portion 56, and a ball portion 52.

In some examples, sole 36 is a generally rigid member having a high degree of stiffness. In some examples, sole 36 is made from a carbon-based resin material such that is lightweight yet has superior strength and fatigue-resistance.

As shown in FIG. 3, a pair of rear cleats 38 is mounted at the rear portion 54 of sole 36 while a front cleat assembly 50 is mounted at the ball portion of sole 36. In one example, cleat assembly 50 includes a base portion 60 that acts as a mounting plate to secure cleat assembly 50 via holes 70A-70C to ball portion 52 of sole 36. In some examples, cleat assembly 50 includes a front cleat 62 protruding outwardly from the base portion 60 and having a generally semi-circular shape. As further shown in FIG. 3, front cleat 62 supports a forwardly protruding toe 64. In some examples, cleat assembly 50 includes a pair of rear cleats 66, each formed in a prong or spike-type shape. However, other shapes of cleats 66 can be used.

In some examples, cleat assembly 50 includes a downwardly protruding flange 68 that is longitudinally spaced apart from toe 64. The flange 68 includes a rearwardly extending lip 192, which is releasably engageable to a portion of a receiver 90 mounted to a footboard 80, as will be later shown and described in more detail.

Figure 4:
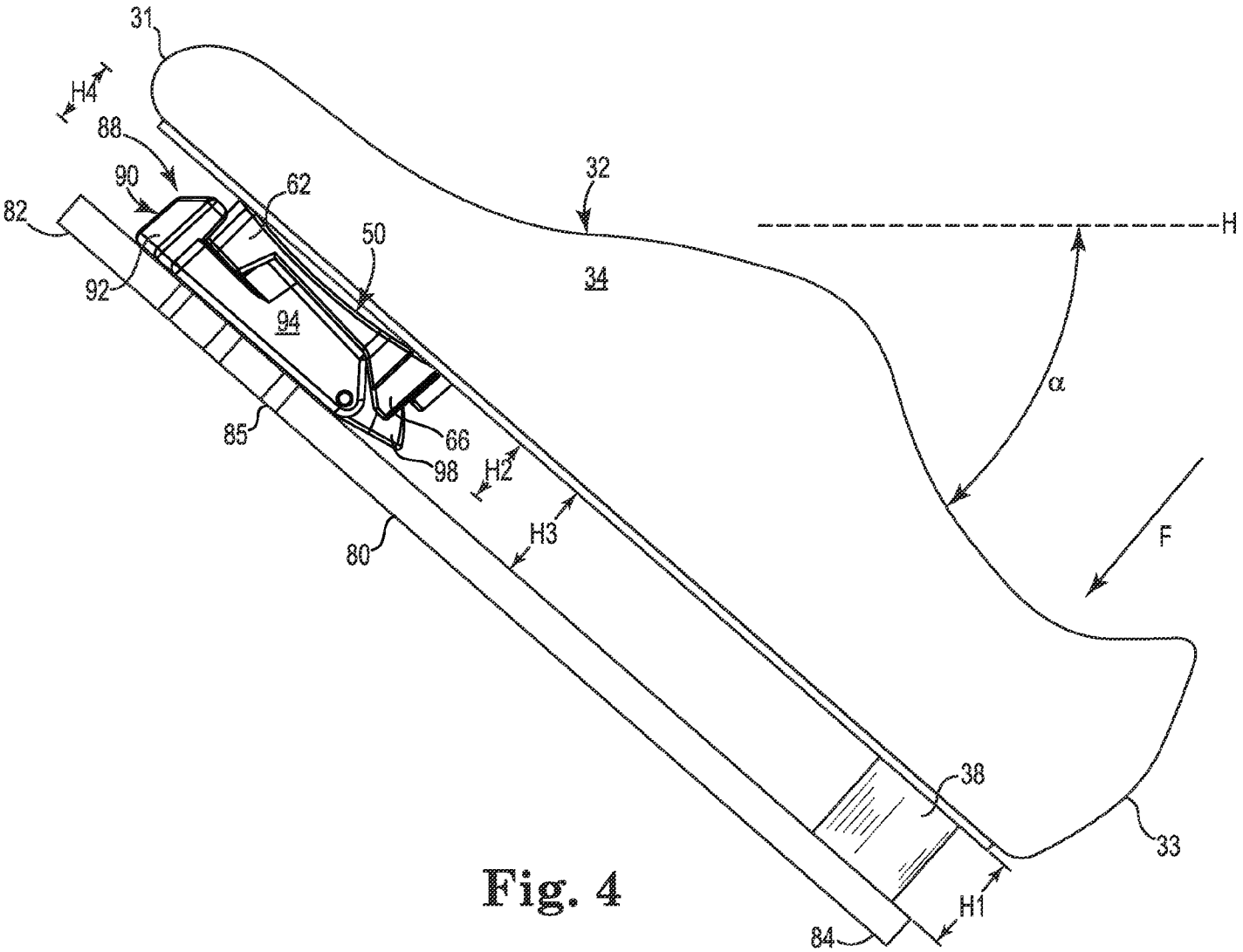
FIG. 4 is side view schematically illustrating a rowing shoe mounted to a footboard via a shoe fastening system, according to one example of the present disclosure.

FIG. 4 is a side view schematically illustrating a rowing shoe 32 releasably engaged relative to a footboard 80 via a rowing shoe fastening system 88, according to an example of the present disclosure. As shown in FIG. 4, a footboard 80 includes a first/upper end portion 82 and an opposite second/lower end portion 84 with receiver 90 mounted (via holes 85) adjacent first/upper end portion 82. Via at least a toe receiving portion 92 and a heel receiving portion 98, the receiver 90 removably retains cleat assembly 50 as will further described later, thereby releasably securing the shoe 32 relative to footboard 80. Together, the receiver 90 and the cleat assembly 50 comprise at least a portion of the rowing shoe fastening system 88. Meanwhile, rear cleat(s) 38 further supports shoe 32 for rowing purposes and for walking in the shoe 32 when the rower is no longer in the rowing scull 10.

In one example of this arrangement, the rear cleat(s) 38 have a height (H1) substantially greater than a height (H4) of the front cleat 62. In some examples, the rear cleats 38 have a height (H1) greater than a height (H2) of the rear cleats 66A, 66B of the cleat assembly 50. In some examples of this arrangement, the height of the rear cleat 38 is at least equal to or exceeds a combined height (H3) of the receiver 90 and the cleat assembly 50 when the cleat assembly 50 is removably engaged relative to the receiver 90, as represented in FIG. 4. In one example, the rear cleat(s) 38 have a height of one inch.

As further shown in FIG. 4, the footboard 80 is oriented at an angle ($\alpha$) relative to the horizontal (represented by dashed lines H). In some examples, angle ($\alpha$) comprises 40 degrees. With this orientation, the rowing shoes 32 and footboard 80 anchor the feet of the rower relative to the housing 14 of the scull, thereby forming a base from which the rower can push and pull themselves in seat 20 along rails 22 during rowing action (FIG. 1). During a pull phase of the rowing cycle, the rower pushes downwardly against the footboard, primarily exerting a driving force (represented by directional force arrow F) through their heels adjacent the rear/heel portion 33 of the shoe 32 and at the rear/lower portion of the footboard 80. In some examples, the rear cleats 38 have a height (H1) uniquely suited to direct the force applied by the rower's legs into the footboard 80.

In one aspect, while the rowing shoe fastening system 88 experiences some of the force resulting from the rower driving their legs in the leg-push phase, it is the heel portion 33 of shoe 32 and rear cleat 38 through which most of the pushing force of the rower is transmitted. This arrangement stands in stark contrast to traditional bicycling behavior in which the bulk of the driving force exerted by the cyclist is received in the pedal via the ball portion of the foot mounted directly over the pedals of the bicycle.

Moreover, in some examples, the footboard 80 does not rotate whereas a bike pedal is continuous experiencing rotation as the cyclist pedals. While a small degree of flexibility (e.g. rotational range of motion) is exhibited within the rowing shoe fastening system 88, in general the rowing shoe fastening system 88 is non-rotatably mounted relative to the footboard 80 and, therefore shoe 32 generally does not rotate relative to the footboard 80.

Meanwhile, during a return phase of the rowing cycle (in which the rower's legs pulls the rower back toward the footboard), the rowing shoe fastening system acts as an anchor to counteract the "pulling force" caused by the rower using their legs to move their body toward the footboard 80.

Figure 5:
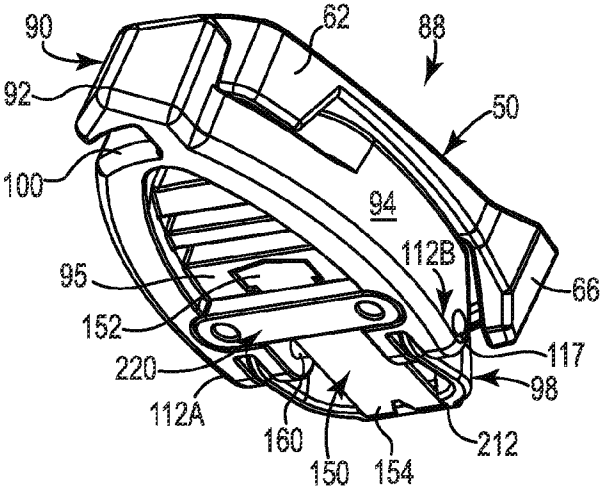
FIG. 5 is a bottom perspective view schematically illustrating a rowing shoe fastening system, according to one example of the present disclosure.

FIG. 5 is a perspective view schematically illustrating the rowing shoe retaining system 88, according to an example of the present disclosure. As shown in FIG. 5, system 88 has at least substantially the same features and attributes as previously described for cleat assembly 50 and receiver 90 in association with FIGS. 1-4. As further shown in FIG. 5, receiver 90 includes numerous components supporting operation of the heel receiving portion 98. In particular, receiver 90 further includes an elongate pressure plate 150 having a first end 152 and an opposite second end 154. The first end 152 is secured relative to a bottom portion 95 of base portion 94 of receiver 90 via a support bar 220 that extends generally transversely relative to a length of the pressure plate 50 (and generally transverse relative to a longitudinal axis of the receiver 90). Meanwhile, the opposite second end 154 of the pressure plate 150 is directly mounted to a lower, edge portion 212 of the heel receiving portion 98. The pressure plate is made from a resilient material, such that pressure plate 50 can be flexed and return to its original shape, and does so with enough force to provide an elastic force or spring-type function. As further described later, with this arrangement the pressure plate 150 provides a controlled biasing force on heel receiving portion 98 to facilitate releasably securing the cleat assembly 50 relative to the receiver 90.

As further shown in FIG. 5, receiver 90 includes a pair of pivot housings 112A, 112B located on opposite sides of the recess 114 (shown best in FIG. 7) through which the pressure plate 150 extends rearwardly toward heel receiving portion 98. The pivot housings 112A, 112B include holes to securely support a rod 160 that enables pivotal movement of the heel receiving portion 98 relative to the base portion 94 of the receiver 90. As shown in FIG. 5, the rod 160 extends transversely across a top surface of the pressure plate 150. While not shown for illustrative simplicity, it will be understood that the receiver 90 includes features to facilitate its mounting to a footboard, such as footboard 80 in FIG. 4.

Figure 6:
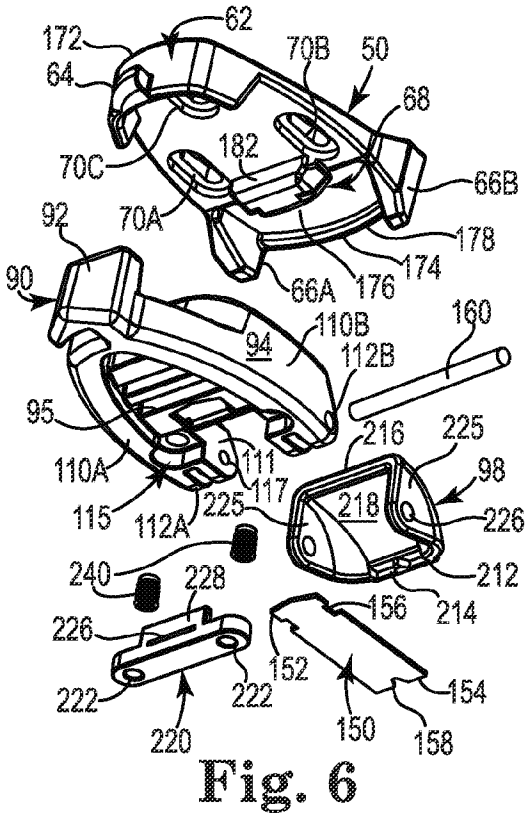
FIG. 6 is an exploded view schematically illustrating the rowing shoe fastening system of FIG. 5, according to one example of the present disclosure.

FIG. 6 is an exploded view schematically illustrating the rowing shoe retaining system 88 of FIG. 5, according to an example of the present disclosure. As further shown in FIG. 6, cleat assembly 50 includes a first end portion 172 at which the front cleat 62 is located and an opposite second end portion 174 at which rear cleats 66A, 66B are located. Just forward of the second end portion 174, cleat assembly 50 defines a recess portion 176 bounded by rear edge/lip 178 that extends transversely between rear cleats 66A, 66B. Interposed between mounting holes 70A, 70B and the recess portion 176, cleat assembly 50 includes the downwardly protruding flange 68 (FIG. 3) configured to releasably engage the heel receiving portion 98, as further described later.

As shown via FIGS. 5-6, in some examples, the rear cleats 66A, 66B are spaced apart by a width greater than a width of the heel receiving portion 98 and greater than a width of the body 94 of the receiver 90. Accordingly, the rear cleats 66A, 66B of the cleat assembly 50 generally straddle the receiver 90 and are located externally to the outer side edges 110A, 110B of the receiver 90.

As further shown in FIG. 6, the bottom portion 95 of receiver 90 includes a recess 115 formed therein to receive mounting of the support bar 220 that secures the first end 152 of the pressure plate 150 relative to receiver 90. In one instance, the support bar 220 includes holes 222 for fasteners 240, a stem 228 for insertion into a recess or slot in bottom portion 95 of receiver 90, and a slot 226 through which the pressure plate 150 extends to facilitate securely retaining the first end 152 of the pressure plate 150.

Figure 7:
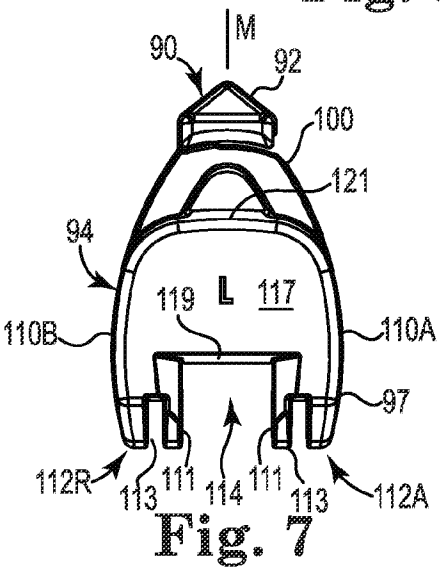
FIG. 7 is a top plan view schematically illustrating a receiver of the rowing shoe fastening system, according to one example of the present disclosure.

As further shown in FIG. 6, heel receiving portion 98 includes a lower, rear edge 212, an upper, front edge 216 and a generally arcuate spine portion 218 extending therebetween. Two generally pie-shaped side portions 225 extend from the spine portion 218 in a generally parallel, spaced apart relationship. Each side portion 225 includes a hole 226. As shown in FIG. 5, a vertex portion of these side portions 225 are slidably received into a channel 113 formed in the pivot housings 112A, 112B at the rear portion of the base member 94 of the receiver 90, which is also shown in FIG. 7. Upon rod 160 being positioned to extend through these holes 226 of heel receiving portion 98 and through holes 117 of pivot housings 112A, 112B, the heel receiving portion 98 is pivotally mounted relative to the rear portion 97 of the base portion 94 of receiver 50. As further described later in association with at least FIG. 17, components other than single rod 160 can be used to pivotally mount the heel receiving portion 98 relative to the pivot housings 112A, 112B at rear portion 97 of the base portion 94 of the receiver 90.

In addition, in some examples, the lower/rear edge 212 of heel receiving portion 98 includes a feature 214 at which the second end 154 of the pressure plate is directly mounted. In some examples, the feature 214 is a protruding structure, while in some examples the feature 214 is a recessed feature. In some examples, the second end 154 of pressure plate 150 is frictionally engaged relative to feature 214, while in some examples, the second end 154 of pressure plate 150 is snap-fit into place. In some examples, an adhesive or fastener is employed to directly mount the second end 154 of the pressure plate relative to the lower/rear edge 212.

Further examples of mounting the pressure plate 150 relative to the heel receiving portion 98 are later described and illustrated in association with at least FIGS. 17-24.

FIG. 7 is a top plan view of receiver 90, according to an example of the present disclosure. As shown in FIG. 7, body 94 of receiver 90 includes a contact pad 117 which is sized and shaped to receive a bottom surface 195 (FIG. 9) of corresponding base portion 60 of cleat assembly 50. Toward the rear portion of the base portion 94, the contact pad 117 terminates in a generally vertical wall 119 that is generally perpendicular to the contact pad 117. Toward the forward area of the base portion 94, the contact pad 117 terminates in a generally vertical wall (or steeply sloped wall) 121. As previously note, the receiver 90 includes a recess 114 extending rearward from the vertical wall 119 and extending transversely between the spaced apart pivot housings 112A, 112B. Among other features, recess 114 provides a pathway through which pressure plate 150 can extend rearward to be directly mounted relative to the lower/rear edge 212 of the heel receiving portion 98, as previously described.

Figure 8:
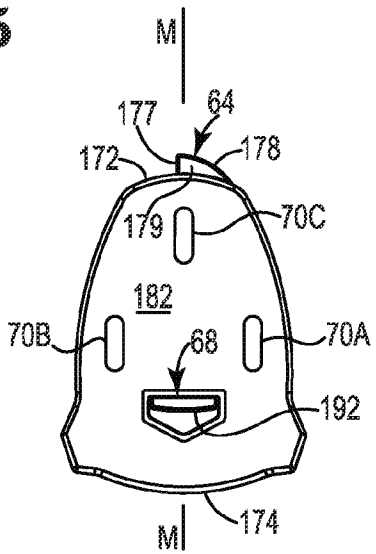
FIG. 8 is a top plan view schematically illustrating a cleat assembly of the rowing shoe fastening system, according to one example of the present disclosure.

FIG. 8 is a top view of cleat assembly 50 of the rowing shoe fastening system 88 of FIGS. 5-6, according to an example of the present disclosure. As shown in FIG. 8, cleat assembly 50 includes a top surface portion 182 for facing and contacting a ball portion of a sole of a shoe. As further shown in FIG. 8, toe 64 protrudes forward from a first end 172 of cleat assembly 50 at which cleat 62 is located. In particular, in some examples, toe 64 is formed on and extends outwardly from an outer surface of cleat 62. In some examples, toe 64 has an inner side wall 177 and an outer curved front wall 178. In one example, the inner side wall 177 is aligned with a midline (M) of the cleat assembly 50 and defines a generally vertical wall that is generally perpendicular to a top surface 179 of toe 64. In one aspect, inner side wall 177 also is generally perpendicular to an apex of an outer surface of cleat 62 from which toe 64 protrudes.

Figure 9:
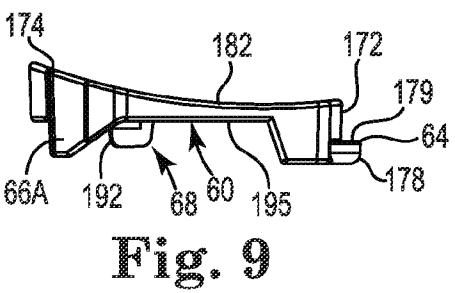
FIG. 9 is a side view schematically illustrating a cleat plate of the rowing shoe fastening system, according to one example of the present disclosure.

FIG. 9 is a side view of cleat assembly 50 of FIGS. 5-6, according to an example of the present disclosure with cleat assembly 50 including at least substantially the same features and attributes as cleat assembly 50 has been previously described and illustrated in association with at least FIGS. 2-8.

Figure 11:
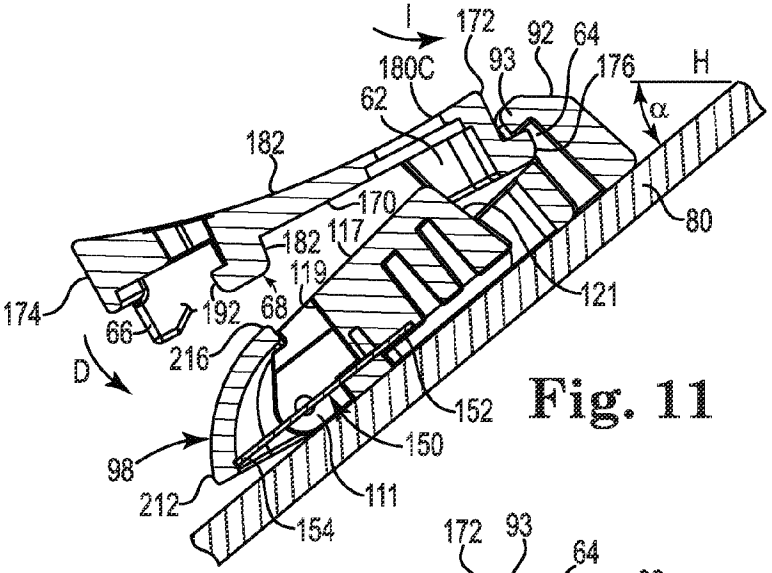
FIG. 11 is a side sectional schematically illustrating the rowing shoe fastening system during the initial stage of removable engagement of the cleat plate with the receiver shown in FIG. 10, according to one example of the present disclosure.
Figure 10:
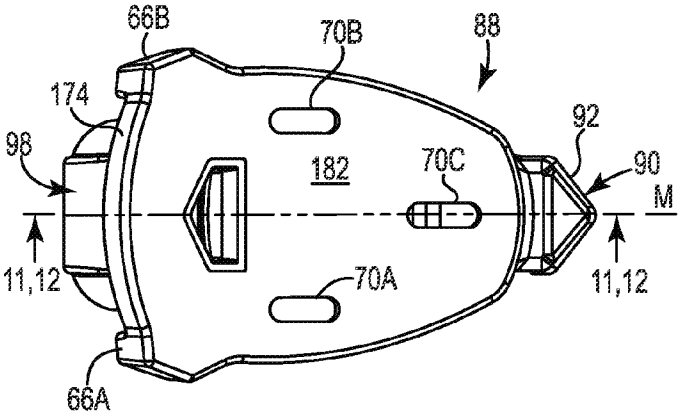
FIG. 10 is a top plan view schematically illustrating the rowing shoe fastening system during an initial stage of removable engagement of the cleat plate with the receiver, according to one example of the present disclosure.

FIG. 10 is a top view and FIG. 11 is a side sectional view of the rowing shoe fastening system 88, during initial stages of releasable engagement of the cleat assembly 50 relative to receiver 90, according to an example of the present disclosure.

As shown in FIG. 10, with the midline M of the cleat assembly 50 aligned with the midline M of the receiver 90 (directly beneath the cleat assembly 50), a rower maneuvers their rowing shoe 32 to insert the toe 64 into the toe receiving portion 92 so that the toe 64 becomes in contact with and engaged relative to the lip 93 of toe receiving portion 92, as represented by directional arrow I. As later shown in FIG. 12, this contact prevents translation of the toe 64 in a first plane, i.e. upward relative to the receiver 90, thereby releasably, securing holding the front portion of the cleat assembly 50 in place relative to the receiver 90.

In this position, as further shown in FIG. 11, the rear portion of the cleat assembly 50 is not yet engaging the rear portion of the receiver 90.

Figure 12:
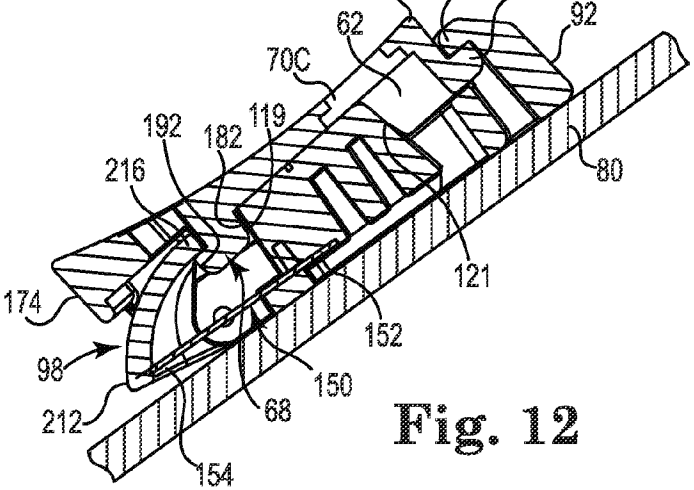
FIG. 12 is a side sectional schematically illustrating the rowing shoe fastening system upon completion of removable engagement of the cleat plate with the receiver, according to one example of the present disclosure.

Next, as part of the same motion of inserting the toe 64 of the cleat assembly 50 into toe receiving portion 92 of receiver 90, the rower pushes down the heel of their shoe 32, which causes the rear portion of the cleat assembly 50 to rotate downward (as represented by directional arrow D) to cause wall 182 of cleat assembly 50 to slidably engage wall 119 of receiver 90. At the same time, this motion positions lip 192 of cleat assembly 50 to be slidably inserted beneath and engaged relative to upper/forward edge 216 of heel receiving portion 98 of receiver 90, as shown in FIG. 12. In particular, in some examples, the rower manually grasps the heel receiving portion 98 and manually overcomes the biasing force exerted by pressure plate 150 to at least partially lift the heel receiving portion 98 upward and forward until upper/forward edge 216 slides over, engages, and releasably securely holds the lip 192 of flange 68 of cleat assembly 50, as shown in FIG. 12. In this arrangement, the biasing force of the pressure plate 150 exerts at least a downward pressure on edge 216 of heel receiving portion 98 against lip 192 of flange 68.

With the cleat assembly 50 releasably secured relative to the receiver 90, as shown in at least FIG. 12, the rower is ready to begin their rowing activity.

Figure 14:
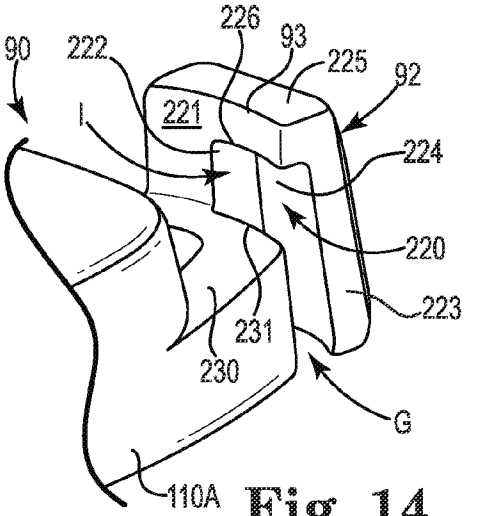
FIG. 14 is an enlarged partial view schematically illustrating a toe receiving portion of the receiver of FIG. 13, according to an example of the present disclosure.
Figure 13:
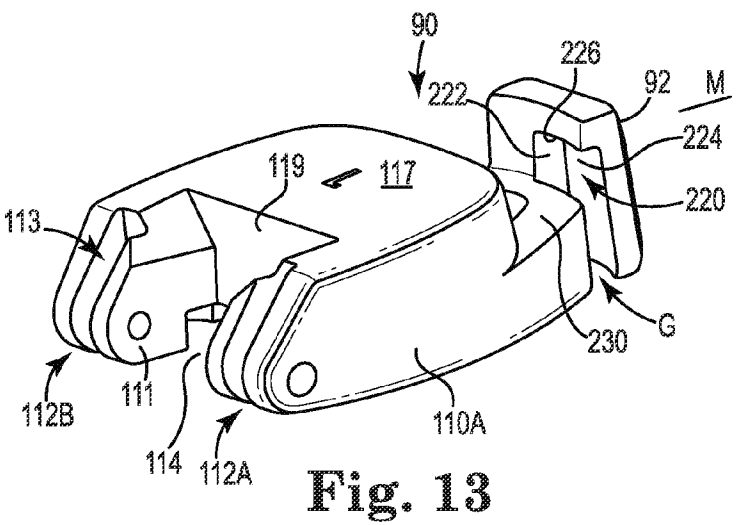
FIG. 13 is a rear perspective view schematically illustrating a receiver of a rowing shoe fastening system, according to an example of the present disclosure.

FIGS. 13-14 further depict the structure and configuration of the toe receiving portion 92 of receiver 90 that facilitate insertion and removable retention of toe 62 of cleat assembly 50, according to one example of the present disclosure. As shown in FIGS. 13-14, toe receiving portion 92 includes a recessed opening or internal corner 220 defined by inner "vertical" side wall 222, "horizontal" or upper wall 226, and inner "vertical" front wall 224. In one aspect, by extending in a first plane (which is a vertical plane if the receiver 50 as a whole is generally extending in a horizontal plane) and via contact with wall 177 (FIG. 8) of toe 64, the inner side wall 222 prevents translation of toe 64 in a first direction in a second plane (i.e. a generally horizontal plane if the receiver 50 as a whole were extending in a horizontal plane). The inner side wall 222 is aligned with, and generally parallel to, a centerline or midline M of the receiver 50, such as shown in at least FIG. 10. Accordingly, in some instances, the inner side wall 222 is referred to as a center vertical wall. In one aspect, inner front wall 224 is spaced longitudinally apart from a front edge portion 231 of the body 94 of the receiver 50 by a distance generally corresponding to a distance by which toe 64 protrudes from the outer surface of front cleat 62 of cleat assembly 50. This spacing defines a gap G, as noted in FIGS. 13-14.

With this arrangement, the gap G permits translation of toe 64 in an opposite second direction of the second (i.e. "horizontal") plane.

In one aspect, once toe 64 of cleat assembly 50 has been fully inserted into the toe receiving portion 92 of receiver 90, upper wall 226 of toe receiving portion becomes engaged by top surface 179 (FIGS. 8-9 of toe 64 to prevent translation of toe 64 in a first "vertical" plane.

As further shown in FIG. 14, a directional arrow I further denotes the direction in which the toe 64 is inserted downwardly and forwardly into the toe receiving portion 92 of receiver 90.

FIG. 14 also further depicts that toe receiving portion 92 includes an outer top wall 225, an outer front wall 223, and an outer side wall 221. In general, top wall 225 at least partially defines lip 93.

Figure 16:
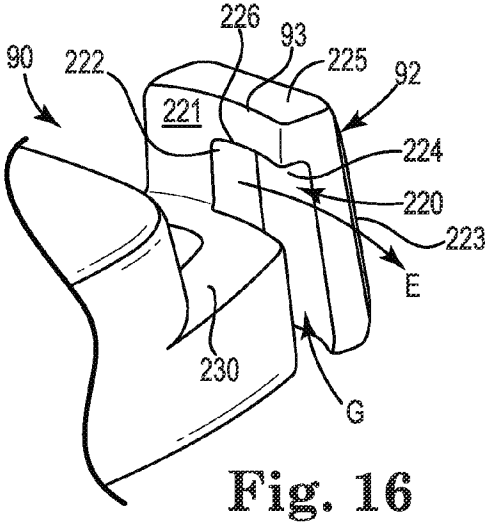
FIG. 16 is an enlarged partial view schematically illustrating a toe receiving portion of the receiver of FIG. 13, according to an example of the present disclosure.
Figure 15:
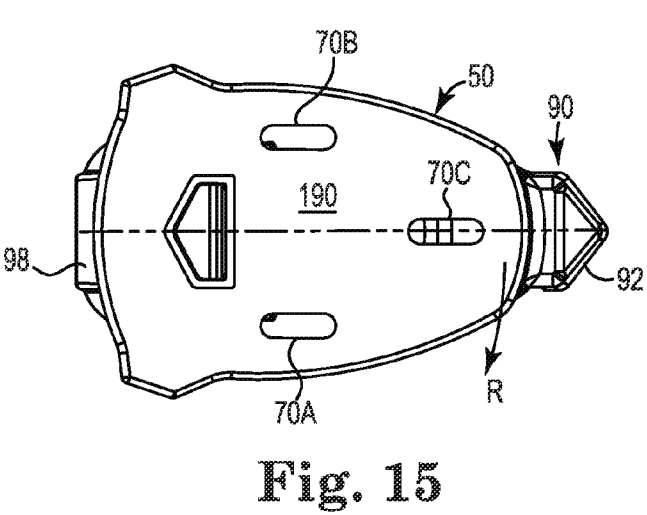
FIG. 15 is a top plan view schematically illustrating the rowing shoe fastening system just prior to removal of the cleat assembly from the receiver, according to one example of the present disclosure.

FIG. 15 is a top plan view of the rowing shoe fastening system 88 just prior to a rower's removal of their shoe 32 from the footboard 80 via removing cleat assembly 50 from receiver 90, according to an example of the present disclosure. With lip 192 of flange 68 of cleat assembly 50 securely retained via heel receiving portion 98 (as shown in at least FIG. 12), the rower begins to rotate the front/toe portion 31 of their shoe 32 outwardly as represented by directional arrow R, which causes the front portion 172 (at front cleat 62) of cleat assembly 50 to rotate outwardly (relative to the fixed, non-rotatable receiver 50) as also represented by directional arrow R in FIG. 15. This outward rotational motion causes the toe 64 to exit the toe receiving portion 92, as represented via directional arrow E, as shown in FIG. 16. Once the toe 64 is clear of the toe receiving portion 92, the rower can simply lift their shoe 32 upward, thereby also causing release of the flange 68 of cleat assembly 50 from the heel receiving portion 98 of receiver 50.

In this way, the rowing shoe fastening system 88 comprises a hands-free quick-release system.

As illustrated in FIGS. 14 and 16, the inner side wall 222 of the toe receiving portion 92 prevents internal rotation of toe 64 beyond the midline (M) of the receiver 90 and/or of the cleat assembly 50, thereby lending stability to rowing shoe fastening system 88 when the cleat assembly 50 is engaged relative to the receiver 50.

Unlike some traditional binding systems which initiate shoe removal via first removing the heel area from a fastener system, at least some examples of the present disclosure initiate removal of a shoe 32 from a footboard (via removal of the cleat assembly 50 from a receiver 90) by first rotating the forward-protruding toe 64 of the cleat assembly while the heel receiving portion 98 of the receiver 90 is still securely restraining the flange 68 of the cleat assembly 50.

However, in some examples, during such rotation of the toe 64 out of the toe receiving portion 90, the heel receiving portion 98 of receiver 50 does permit a minor flexing or rotation of the cleat assembly 50 relative to the heel receiving portion 98 of receiver 90, such as up to 3 degrees rotation.

FIGS. 17-24 depict further examples of a heel receiving portion of a rowing shoe fastening system 88, according to an example of the present disclosure, each of which can replace the heel receiving portion 98 in the examples of FIGS. 2-16.

FIG. 17 is a perspective view of a heel receiving portion 300, according to one example of the present disclosure, and that includes at least substantially the same features and attributes as heel receiving portion 98 (as previously described) except that single rod 160 (FIGS. 5-6) is replaced with two separate pins 302A, 302B with each having a length just long enough such that one of the respective pins 302A, 302B will occupy a corresponding one of the respective pivot housings 112A, 112B in receiver 90 and in holes 226 of the heel receiving portion 98 (see FIGS. 5-7).

In FIG. 18, according to an example of the present disclosure, a heel receiving portion 310 omits a spine portion (such as spine portion 308 in FIG. 17) and but does include a lower/rear edge 312 and an upper/forward edge 316. Two upper arms 319 descend downwardly from upper/forward edge 316 while two lower arms 321 extend from lower/rear edge 312 toward holes 326. A flange 328 is formed at each junction of an upper arm 319 and a lower arm 321, and a hole 326 is defined therein for receiving a rod 160 (FIGS. 5-6) or one pin (FIG. 17). A second end 154 of a pressure plate 150 (FIGS. 5-6) is directly mounted to a coupling feature 314, as shown in FIG. 18.

FIG. 19 is perspective view of a heel receiving portion 340, according to one example of the present disclosure. As shown in FIG. 19, the heel receiving portion 340 includes an arcuate spine portion 308 that extends between two spaced apart sides 325, as in FIG. 5. However, in this example, a bottom wall 360 or member also extends between the spaced apart sides 325. In this example, a pressure plate 150 is provided with a shorter overall length and its second end 152 is mounted directly relative to an outer edge 363 of the shelf-like member 360 instead of being mounted to lower/rear edge 312.

FIG. 20 is perspective view of a heel receiving portion 380, according to one example of the present disclosure, in which the second end 152 of the pressure plate 150 (FIG. 5) is directly mounted within slots 392 of at least a pair of ribs 390 formed on and/or extending forward from arcuate spine portion 387.

FIG. 21 is a perspective view of a heel receiving portion 400, according to an example of the present disclosure that includes substantially the same features and attributes as heel receiving portion 310 (FIG. 18) except that heel receiving portion 400 omits a lower/rear edge portion (i.e. lower/rear edge 312 in FIG. 18). Instead, each of two spaced apart lower arms 421 terminate at ends 421E. In this example, there is no lower/rear edge to which second end 152 of pressure plate 150 can be secured. Rather, as shown in FIG. 22A, a pressure plate 430 includes a second end 432 that extends beyond the ends 421E of arms 421 and that has a generally T-shaped configuration with arms 433 extending out laterally from a main body 431 of pressure plate 430. Each arm 433 of the pressure plate 430 includes an end 435 that extends laterally beyond the end 421E of the arm 421. As further shown in FIG. 22B, in some examples, each arm 433 of the pressure plate 430 is received within a slot 422 of the arm 421 near end 421E of each arm 421 of heel receiving portion 400.

In another example, heel receiving portion 400 of FIG. 21 also employs a T-shaped pressure plate 440 as shown in FIGS. 23A-23B, according to an example of the present disclosure. However, each lower arm 421 of heel receiving portion 400 includes a slot 447 formed in a midportion of each arm 421 of heel receiving portion instead of at an end 421E. One of the respective arms 443 of the pressure plate is slidably insertable into and through slot 447 to thereby secure a second end 442 of the pressure plate 440.

FIG. 24 is a perspective view of heel receiving portion 450, according to an example of the present disclosure, and has at least substantially the same features and attributes as heel receiving portion 98 except for including an interior shelf 458. The second end 152 of a pressure plate 150 (FIGS. 5-6) is directly mountable to an outer edge 470 (at which a fastener or recess may be located) of shelf 458.

The different examples described and illustrated in association with FIGS. 17-24 provide a wide range of variability regarding a position and manner of directly mounting a second end of a pressure plate (e.g. 150) for resiliently biasing a heel receiving portion. It will be further understood that a shape and/or size of the pressure plate can be modified (via adding bends, curves, etc.) along a length of the pressure plate to accommodate the various examples described and illustrated in association with at least FIGS. 17-24.

Figure 25:
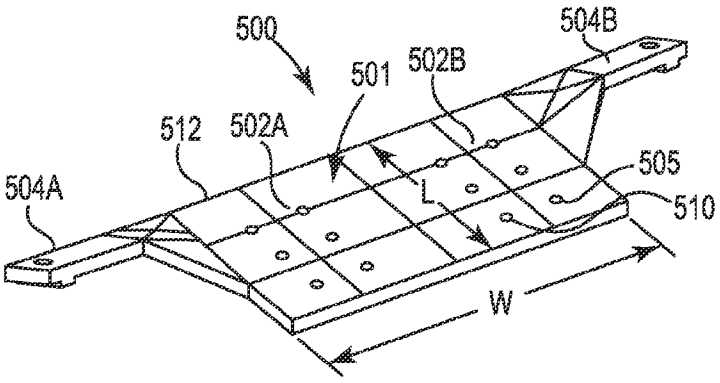
FIG. 25 is a perspective view schematically illustrating a footboard of a rowing shoe support system, according to one example of the present disclosure.
Figure 26:
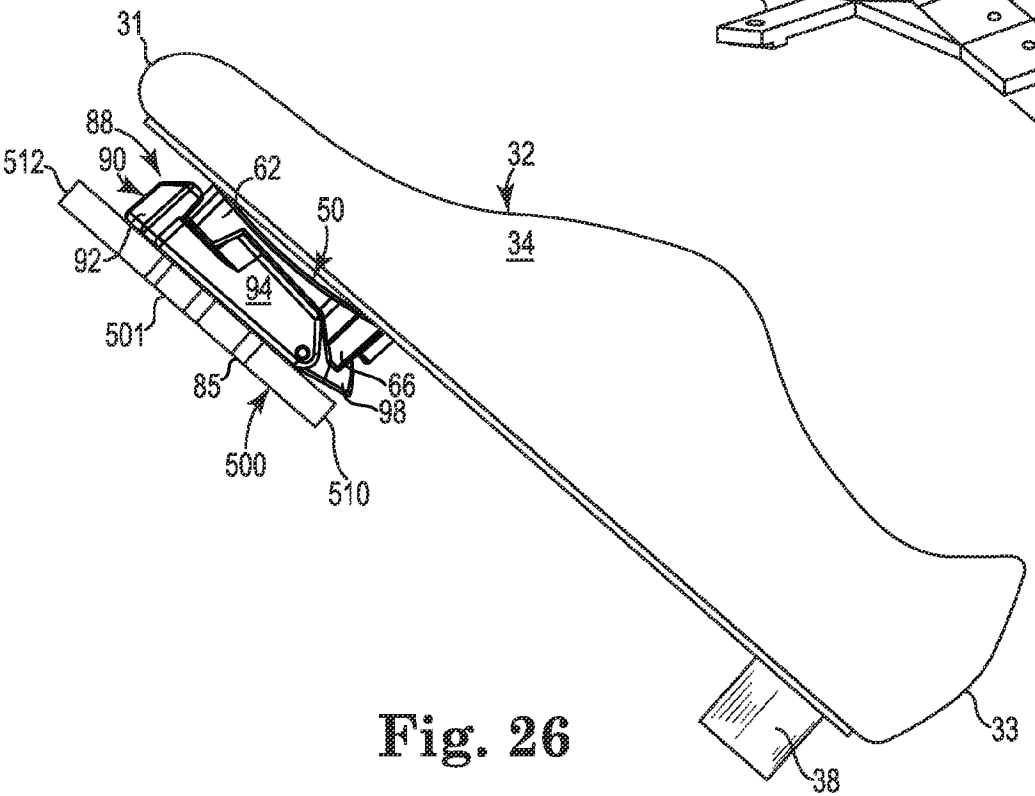
FIG. 26 is a side view schematically illustrating a rowing shoe fastening system mounted to a footboard, according to one example of the present disclosure.

FIG. 25 is a perspective view of a footboard 500 and FIG. 26 is a side view of a shoe 32 mounted on footboard 500, according to an example of the present disclosure. As shown in FIG. 24, the footboard 500 includes a main body portion 501 with two side-by-side foot pad areas 502A, 502B at which rowing shoes are mountable via one of several sets of mounting holes 505. Main body 501 extends from a top edge portion 512 to a lower edge portion 510. Adjacent the top edge portion 512, elongate support arms 504A, 504B extend in laterally outward, opposite directions from main body 501. Each support arm 504A, 504B is sized and shaped for securing the footboard 500 relative to a portion (e.g., side wall, gunnel, etc. of the rowing scull).

In one aspect, main body 501 has a width (W) wide enough to accommodate mounting of two shoes and has a length (L) just long enough to mount a ball portion of a rowing shoe (via a rowing shoe fastening system according to examples of the present disclosure) but not long enough to support a heel portion of a rowing shoe. Rather, in this example, instead of relying a lower portion of a footboard to support and receiving the driving force (F) normally applied through the heel of the shoe by the rower, a stiffness of the sole of the shoe and the strength and rigidity of the footboard 500 of the rowing shoe fastening system 98 replaces the function formerly provided by the lower "heel" portion of a traditional footboard.

In some examples, the footboard 500 in this example will have up to 50 percent less total material, thereby decreasing weight of the footboard. Moreover, frame portions that are traditionally employed to provide a foundation for a footboard would no longer be needed, thereby even further reducing the weight in the rowing sculls. In rowing sculls with a higher number of rowers (e.g. 8), this weight reduction would result in a significant reduction in weight of the rowing scull, and thereby contributing to better racing performance.

In one aspect, the footboard is made of a carbon reinforced resin material to provide superior stiffness and thereby resist unwanted flexure of the footboard 500 in a direction parallel to the thrusting force of the rowers, which might otherwise interfere with proper rhythm and momentum during a rowing cycle.

With further reference to FIG. 26, it is noted that despite the absence of a lower "heel" portion of the footboard, the shoe 32 retains the rear cleat(s) 38 to enhance the walking capability of the rower when the rower is not in the rowing scull.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

What is claimed is:

1. A rowing shoe fastening system comprising:

a cleat assembly mountable to at least a ball portion of a sole of a rowing shoe and including a forwardly extending toe and a rearwardly extending lip spaced apart longitudinally from the toe;

a receiver mountable to a footboard of a rowing boat and having a base extending longitudinally between a toe receiving portion and a heel receiving portion, wherein the toe receiving portion permits slidable insertion of the toe, and once inserted, the toe receiving portion prevents translation of the toe in a first plane, permits lateral translation of the toe in a laterally outward direction in a second plane generally perpendicular to the first plane while preventing translation of the toe in an opposite laterally inward direction in the second plane;

wherein the heel receiving portion is biased via a resilient member to permit slidable insertion of the lip of the cleat assembly to become engaged relative to an upper, forward edge of the heel receiving portion, and wherein, after insertion of the lip of the cleat assembly within the heel receiving portion, the heel receiving portion retains the lip of the cleat assembly at least until after the toe of the rowing shoe has been laterally translated out of the toe receiving portion.

2. The rowing shoe fastening system of claim 1, wherein the receiver is non-rotatably mounted relative to the footboard.

3. The rowing shoe fastening system of claim 1, wherein the footboard includes a footpad portion interposed between two elongate support members extending outwardly in opposite directions from the footpad portion, wherein an outer end of the two elongate support members is mountable to at least one of a side wall and a gunnel of the rowing shell, wherein the footpad portion includes a top edge and a bottom edge and is sized to correspond to a ball portion of a rowing shoe without directly supporting a heel portion of the rowing shoe.

4. The rowing shoe fastening system of claim 1, wherein the toe receiving portion includes a center vertical wall aligned with a midline of the receiver that, after insertion of the toe, prevents lateral translation of the toe in the second direction in the second plane.

5. The rowing shoe fastening system of claim 4, wherein the toe includes an inner side wall that extends in a third plane, when the toe is inserted into the toe receiving portion, which is generally parallel to the center vertical wall.

6. The rowing shoe fastening system of claim 4, wherein the center vertical wall of the toe receiving portion is aligned with a midline of the cleat assembly.

7. The rowing shoe fastening system of claim 1, wherein the heel receiving portion includes:

a pivot region pivotally mounted relative to a body of the receiver; and a rearward, lower edge directly mountable to a second end of the resilient member, wherein an opposite first end of the resilient member is fixed to the body of the receiver.

8. The rowing shoe fastening system of claim 7, wherein the heel receiving portion comprises a shell including a pair of spaced apart side portions and an arcuate spine extending between the respective side portions.

9. The rowing shoe fastening system of claim 7, wherein each side portion of the shell generally defines a pie shape having a vertex, and wherein a hole in each side portion located adjacent the vertex at least partially defines the pivot region of the heel receiving portion.

10. The rowing shoe fastening system of claim 1, wherein the cleat assembly includes a first end and an opposite second end with the forwardly extending toe being located at the first end and the lip located at a location intermediate between the first end and the second end.

11. The rowing shoe fastening system of claim 10, wherein the cleat assembly includes a pair of spaced apart cleats located adjacent the second end and on opposite sides of the midline of the cleat assembly, wherein the space between the cleats is greater than a width of the arcuate spine of the heel receiving portion and wherein the space between the cleats is greater than a width of the receiver.

12. The rowing shoe fastening system of claim 10, wherein the cleat assembly includes a front cleat located at the first end of the cleat assembly, forms a generally arcuate shape, and the toe is formed as a protrusion on an outer surface of the front cleat.

13. The rowing shoe fastening system of claim 12, wherein the arcuate shape of the front cleat comprises a generally semi-circular shape.

14. The rowing shoe fastening system of claim 12, wherein at least one rear cleat is mounted to a rear portion of a sole of the rowing shoe and the at least one rear cleat has a height exceeding a height of the front cleat.

15. The rowing shoe fastening system of claim 14, wherein the height of the at least one rear cleat exceeds a combined height of the receiver and the cleat assembly when the cleat assembly is removably engaged relative to the receiver.

* * * * *